US008444431B1

(12) United States Patent
La Salvia

(10) Patent No.: US 8,444,431 B1
(45) Date of Patent: May 21, 2013

(54) INSULATION PIERCING CONNECTOR ASSEMBLIES AND METHODS AND CONNECTIONS INCLUDING SAME

(75) Inventor: José Alexandre La Salvia, São José dos Campos (BR)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 13/299,972

(22) Filed: Nov. 18, 2011

(51) Int. Cl.
*H01R 4/24* (2006.01)

(52) U.S. Cl.
USPC ..... 439/404; 439/411; 439/781

(58) Field of Classification Search
USPC ..... 439/404, 405, 411–413, 395, 781, 439/782
See application file for complete search history.

(56) References Cited

U.S. PATENT DOCUMENTS

| | | | | |
|---|---|---|---|---|
| 5,174,782 | A * | 12/1992 | Bogiel et al. | 439/404 |
| 5,429,530 | A * | 7/1995 | Zander et al. | 439/620.26 |
| 5,722,850 | A * | 3/1998 | White | 439/404 |
| 6,135,804 | A | 10/2000 | Lux | |
| 6,648,671 | B2 * | 11/2003 | Suzuki et al. | 439/404 |
| 6,692,292 | B2 | 2/2004 | Huiskamp et al. | |
| 6,780,044 | B1 | 8/2004 | Sawyer et al. | |
| 7,695,306 | B2 * | 4/2010 | Chiba | 439/404 |
| 8,016,622 | B2 | 9/2011 | Battle | |

FOREIGN PATENT DOCUMENTS

EP 2 360 790 8/2011

OTHER PUBLICATIONS

"4 POS Block Ass'y" Tyco Electronics Brasil LTDA, Released Date: Apr. 28, 2009 (1 page).
"6 POS Block Ass'y" Tyco Electronics Brasil LTDA, Released Date: May 5, 2009 (1 page).
"8 POS Block Ass'y" Tyco Electronics Brasil LTDA, Released Date: May 11, 2009 (1 page).
"CDP Conector Derivacao Perfurante Insulated Piercing Connector" Intelli-Industria de Terminais Eletricos Ltda, set/2010 (2 pages).
"Conector Perfurante NFC 33 020" Incesa, (2 pages).
"DCNL—Insulated Piercing Connectors" Cavanna Group, (2 pages).
"Electric Cable Fittings, Insulation Piercing Connector (IPC Connector)" Zhejiang Tianhong Electric Power Fitting Co. Ltd., Retrieved Date: Nov. 21, 2011, From URL: http://www.powerfittings.com/1-1-insulation-piercing.html (1 page).

(Continued)

*Primary Examiner* — Gary F. Paumen
(74) *Attorney, Agent, or Firm* — Myers Bigel Sibley & Sajovec, PA

(57) ABSTRACT

An electrical connector assembly for mechanically and electrically connecting first and second cables each including an elongate electrical conductor covered by an insulation layer includes a housing configured to receive the cables, an electrically conductive bus member in the housing, an electrically conductive first and second blade members in the housing each having an inner end, an outer end and an insulation piercing feature on the outer end. The inner ends are coupled to the bus member and the insulation piercing features each include at least one tooth configured to pierce through the insulation covers of the cables and electrically engage the cable conductor. The bus member provides electrical continuity between the first and second blade members and thereby the conductors of the first and second cables when the conductors are engaged by the insulation piercing feature of the first and second blade members.

20 Claims, 10 Drawing Sheets

OTHER PUBLICATIONS

"Ilsco Insulation Piercing Connectors" Munro Electrical Supplies, Retrieved Date: Nov. 21, 2011, From URL: http://www.munroelectric.com/catalog/ilsco/insulation.html (1 page).

"Insulation piercing connector for customer service information" Tyco Electronics SIMEL S.A.S.—Energy Division, Ref: SIM 00—Mar. 2002 (2 pages).

"Insulation Piercing Connectors for insulated overhead lines" Tyco Electronics SIMEL S.A.S.—Energy Division, Ref: SIM127—Mar. 2003 (2 pages).

"Insulation piercing connector for main to main connection" Tyco Electronics Simel S.A.S.—Energy Division, Ref: SIM 007—Mar. 2002 (2 pages).

"Insulation Piercing Connectors for street lighting applications" Tyco Electronics SIMEL S.A.S.—Energy Division, Ref: SIM005-Revised—Jul. 26, 2004 (1 page).

"Insulation Piercing Connectors-IPC" Galvin Industries, Inc., Retrieved Date: Nov. 21, 2011, From URL: http://www.galvanelectrical.com/cataloq/insulationPiercingConnectors.asp, 1 page.

"IPC Insulated Piercing Connector" Yueqing Zhicheng Electrical Equipment Co., Ltd., Retrieved Date: Nov. 21, 2011, From URL: http://ceexinyu.en.made-in-china.com/product/YMjnZCQvfLVh/China-IPC-Insulated-Piercing-Connector.html (1 page).

"IPC-Insulation Piercing Connectors for Aerial Bundle Cable" EC21 Global B2B Marketplace, Retrieved Date: Nov. 21, 2011, From URL: http://www.ec21.com/product-details/IPC-Insulation-Piercing-Connectors-for--4875553.html (3 pages).

"IPC with 4 POS Block" Tyco Electronics Brasil LTDA, Released Date: Apr. 29, 2009 (1 page).

"IPC with 6 POS Block" Tyco Electronics Brasil LTDA, Released Date: May 7, 2009 (1 page).

"IPC with 8 POS Block" Tyco Electronics Brasil LTDA, Released Date: May 7, 2009 (1 page).

"KZ y JZ Conectores Perforantes de Aislamiento IPC" Tyco Electronics Energy Division, Tyco Electronics Brasil S.A. (2 pages).

"Low Voltage Insulated Overhead Lines (LV ABC)" Tyco Electronics Simel S.A. Energy Division, Mod 03/01—PN: 1242421 / Code: 021444 (12 pages).

"New Improved Product MSC Series Multiple Service Conductor" Sicame Australia Ply Ltd., Installation Instruction No. 15, Issue No. 6, Date of Issue: Sep. 5, 2008 (3 pages).

"Service Insulation Piercing Connectors for Insulated Overhead Lines: P2X95 Mk2" Tyco Electronics SIMEL S.A.S.—Energy Division, Ref: SIM200—Apr. 20, 2009 (1 page).

Notification of Transmittal of the International Search Report and Written Opinion of the International Searching Authority, or the Declaration in corresponding PCT Application No. PCT/BR2012/000440, mailed Jan. 30, 2013 (14 pages).

* cited by examiner

INSULATION PIERCING CONNECTOR ASSEMBLIES AND METHODS AND CONNECTIONS INCLUDING SAME

FIELD OF THE INVENTION

The present invention relates to electrical connectors and, more particularly, to power utility electrical connectors and methods and connections including the same.

BACKGROUND OF THE INVENTION

Electrical utility firms constructing, operating and maintaining overhead and/or underground power distribution networks and systems utilize connectors to tap main power transmission conductors and feed electrical power to distribution line conductors, sometimes referred to as tap conductors. The main power line conductors and the tap conductors are typically high, medium or low voltage cables that are relatively large in diameter, and the main power line conductor may be differently sized from the tap conductor, requiring specially designed connector components to adequately connect tap conductors to main power line conductors.

Insulation piercing (IP) connectors are commonly used to form mechanical and electrical connections between insulated cables. Typically, an IP connector includes metal piercing blades with sets of teeth on either end thereof. The piercing blades are mounted in housing members (e.g., along with environmental sealing components). The housing members are clamped about the insulated main and tap cables so that one set of teeth of a piercing blade engages the main cable and the other set of teeth of the piercing blade engages the tap cable. The teeth penetrate the insulation layers of the cables and make contact with the underlying conductors, thereby providing electrical continuity between the conductors through the piercing blade.

SUMMARY OF THE INVENTION

According to embodiments of the present invention, an electrical connector assembly for mechanically and electrically connecting first and second cables each including an elongate electrical conductor covered by an insulation layer includes a housing, an electrically conductive bus member, an electrically conductive first blade member, and an electrically conductive second blade member. The housing is configured to receive each of the first and second cables. The bus member is disposed in the housing. The first blade member is disposed in the housing and has an inner end, an outer end and an insulation piercing feature on the outer end. The inner end is coupled to the bus member and the insulation piercing feature includes at least one tooth configured to pierce through the insulation cover of the first cable and electrically engage the conductor of the first cable. The second blade member is disposed in the housing and has an inner end, an outer end and an insulation piercing feature on the outer end. The inner end is coupled to the bus member and the insulation piercing feature includes at least one tooth configured to pierce through the insulation cover of the second cable and electrically engage the conductor of the second cable. The bus member provides electrical continuity between the first and second blade members and thereby the conductors of the first and second cables when the conductors are engaged by the insulation piercing feature of the first and second blade members.

According to method embodiments of the present invention, a method for mechanically and electrically connecting first and second cables each including an elongate electrical conductor covered by an insulation layer includes providing an electrical connector assembly including: a housing configured to receive each of the first and second cables; an electrically conductive bus member disposed in the housing; an electrically conductive first blade member disposed in the housing and having an inner end, an outer end and an insulation piercing feature on the outer end, wherein the inner end is coupled to the bus member and the insulation piercing feature includes at least one tooth configured to pierce through the insulation cover of the first cable and electrically engage the conductor of the first cable; and an electrically conductive second blade member disposed in the housing and having an inner end, an outer end and an insulation piercing feature on the outer end, wherein the inner end is coupled to the bus member and the insulation piercing feature includes at least one tooth configured to pierce through the insulation cover of the second cable and electrically engage the conductor of the second cable. The method further includes: placing the first cable in the housing and forcing the first blade member into engagement with the first cable such that the at least one tooth of the first blade member pierces through the insulation cover of the first cable and electrically engages the conductor of the first cable; and placing the second cable in the housing and forcing the second blade member into engagement with the second cable such that the at least one tooth of the second blade member pierces through the insulation cover of the second cable and electrically engages the conductor of the second cable, wherein the bus member provides electrical continuity between the first and second blade members and thereby the conductors of the first and second cables.

According to embodiments of the present invention, an electrical connector assembly for mechanically and electrically connecting first and second cables each including an elongate electrical conductor covered by an insulation layer includes a housing, an electrically conductive first contact member, and an electrically conductive second contact member. The housing is configured to receive each of the first and second cables. The first contact member is disposed in the housing. The first contact member includes an insulation piercing feature including at least one tooth configured to pierce through the insulation cover of the first cable and electrically engage the conductor of the first cable. The second contact member is disposed in the housing. The second contact member includes an insulation piercing feature including at least one tooth configured to pierce through the insulation cover of the second cable and electrically engage the conductor of the second cable. The electrical connector assembly further includes an integral electrical protection functional component disposed in the housing and electrically connecting the first and second contact members.

Further features, advantages and details of the present invention will be appreciated by those of ordinary skill in the art from a reading of the figures and the detailed description of the preferred embodiments that follow, such description being merely illustrative of the present invention.

DETAILED DESCRIPTION OF EMBODIMENTS OF THE INVENTION

Figure 1:
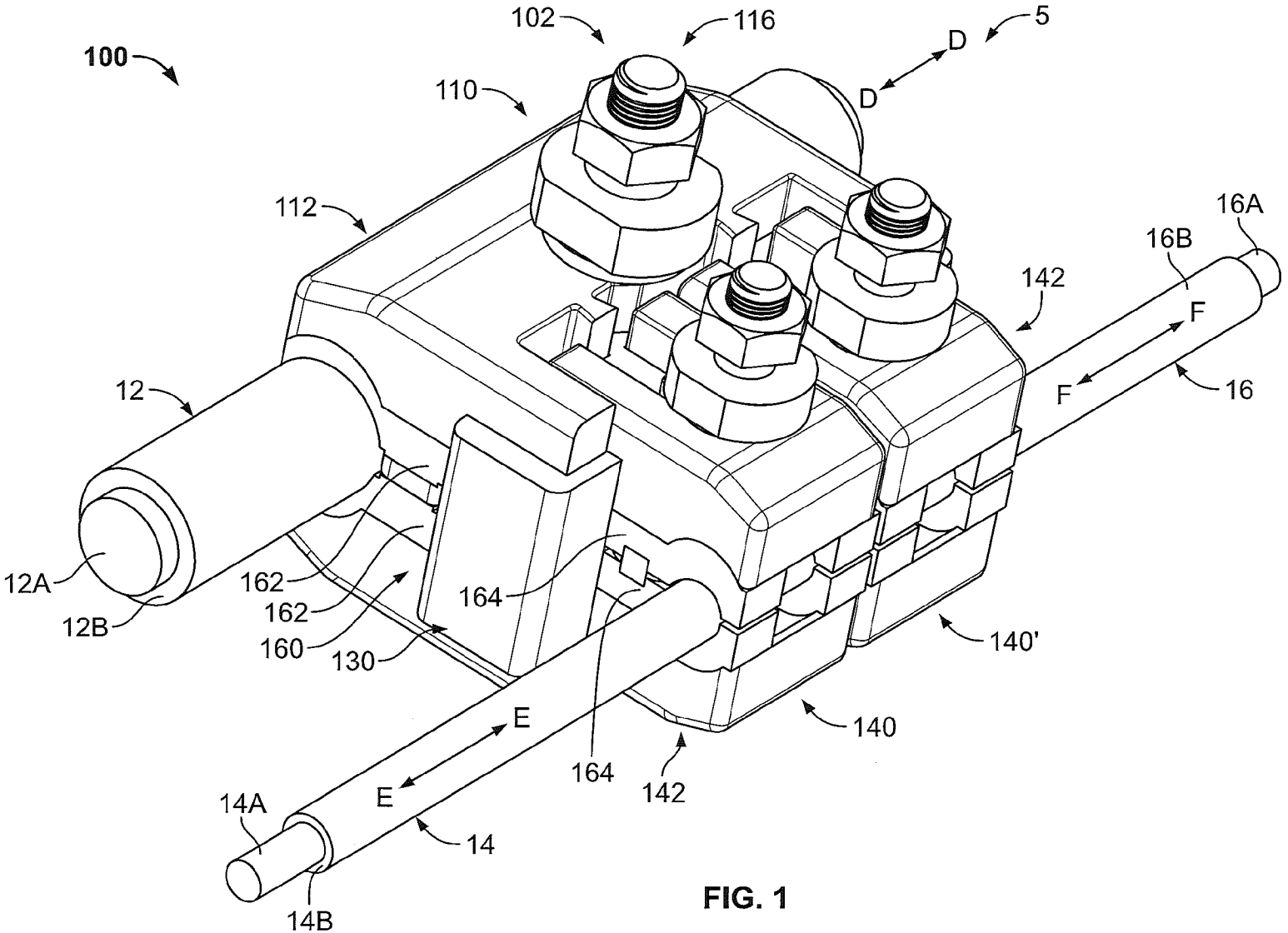
FIG. 1 is a perspective view of a connection including a connector assembly according to embodiments of the present invention.

The present invention now will be described more fully hereinafter with reference to the accompanying drawings, in which illustrative embodiments of the invention are shown. In the drawings, the relative sizes of regions or features may be exaggerated for clarity. This invention may, however, be embodied in many different forms and should not be construed as limited to the embodiments set forth herein; rather, these embodiments are provided so that this disclosure will be thorough and complete, and will fully convey the scope of the invention to those skilled in the art.

It will be understood that when an element is referred to as being "coupled" or "connected" to another element, it can be directly coupled or connected to the other element or intervening elements may also be present. In contrast, when an element is referred to as being "directly coupled" or "directly connected" to another element, there are no intervening elements present. Like numbers refer to like elements throughout.

In addition, spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein the expression "and/or" includes any and all combinations of one or more of the associated listed items.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of this disclosure and the relevant art and will not be interpreted in an idealized or overly formal sense unless expressly so defined herein.

As used herein, "monolithic" means an object that is a single, unitary piece formed or composed of a material without joints or seams.

With reference to FIGS. 1-8, a multi-tap or multi-cable insulation piercing connector assembly 100 according to embodiments of the present invention is shown therein. The connector assembly 100 can be used to form an insulation piercing connector (IPC) connection 5 (FIG. 1) including elongate electrical cables 12, 14, 16 (e.g., electrical power lines) mechanically and electrically coupled by the connector assembly 100. The connector assembly 100 may be adapted for use as a tap connector for connecting one or more elongate tap cables 14, 16 to an elongate main cable 12 of a utility power distribution system, for example.

Each tap cable 14, 16, sometimes referred to as a distribution conductor, may be a known electrically conductive metal high, medium or low voltage cable or line having a generally cylindrical form in an exemplary embodiment. The main cable 12 may also be a generally cylindrical high, medium or low voltage cable line. The tap cable 14 includes a metal electrical conductor 14A surrounded by an insulation layer 14B. The tap cable 16 includes a metal electrical conductor 16A surrounded by an insulation layer 16B. The main cable 12 includes a metal electrical conductor 12A surrounded by an insulation layer 12B. The conductors 12A, 14A, 16A may be solid cylindrical conductors (solid wire) as illustrated in the figures. Alternatively, one or more of the conductors 12A, 14A, 16A may be formed of multiple strands (e.g., twisted strands). Multi-strand conductors may be easier to handle with better bending characteristics. Suitable materials for the conductors 12A, 14A, 16A may include aluminum or copper. The insulation layers 12B, 14B, 16B may be formed of a polymeric material such as PVC, polypropylene, polyethylene, or cross-linked polyethylene. The tap conductors 14A, 16A and the main conductor 12A may be of the same wire gauge or different wire gauge in different applications and the connector assembly 100 is adapted to accommodate a range of wire gauges for each of the tap conductors 14A, 16A and the main conductor 12A. The cable 12 has a lengthwise axis D-D, the cable 14 has a lengthwise axis E-E and the cable 16 has a lengthwise axis F-F.

When installed to the tap cables 14, 16 and the main cable 12, the connector assembly 100 provides electrical connectivity between the main conductor 12A and the tap conductors 14A, 16A to feed electrical power from the main conductor 12A to the tap conductors 14A, 16A in, for example, an electrical utility power distribution system. The power distribution system may include a number of main cables of the same or different wire gauge, and a number of tap cables of the same or different wire gauge.

Figure 2:
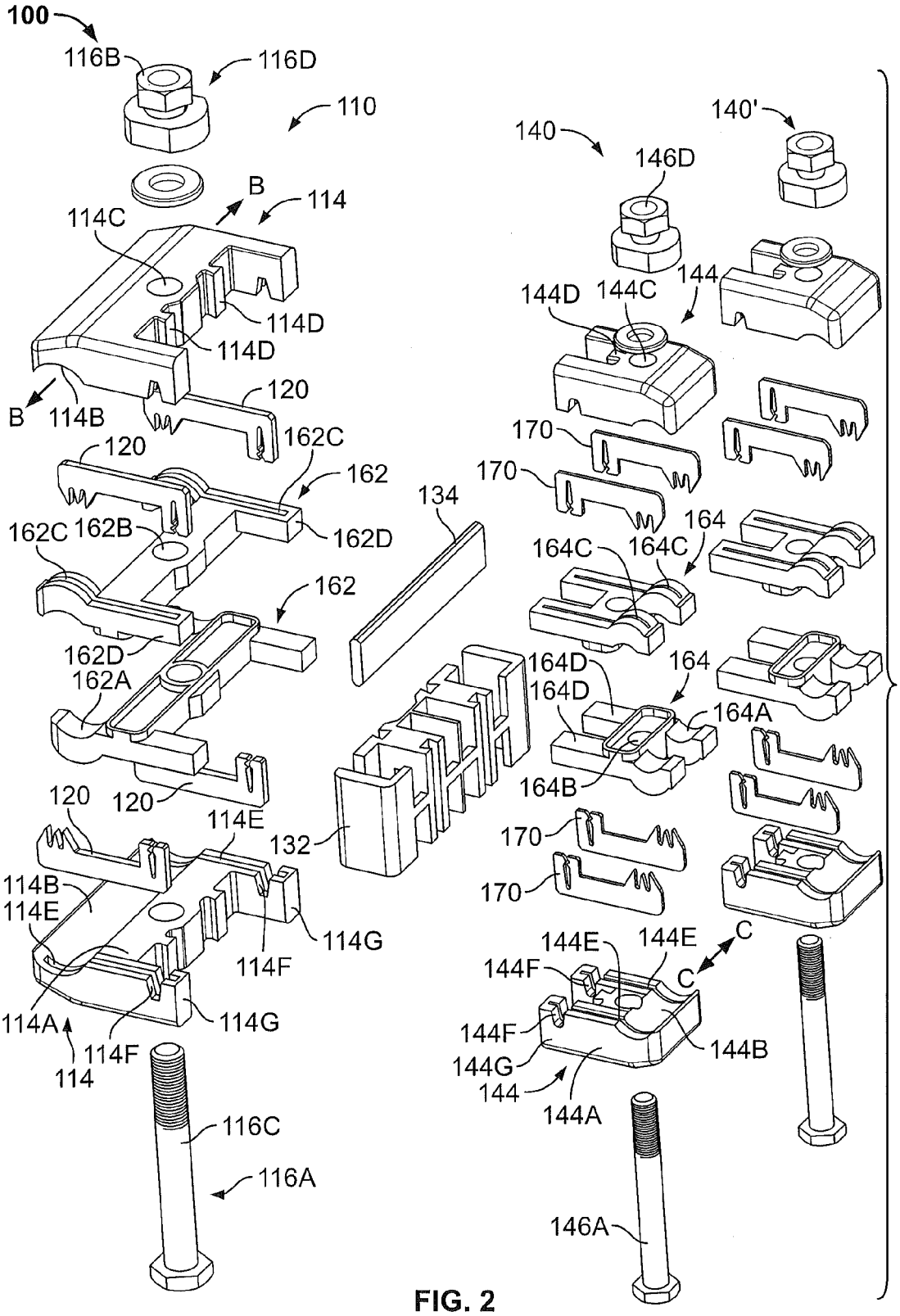
FIG. 2 is an exploded perspective view of the connector assembly of FIG. 1.

With reference to FIGS. 1 and 2, the connector assembly 100 includes a main subassembly 110, a bus subassembly 130, a first tap subsassembly 140 and a second tap subassembly 140'. The connector assembly 100 includes a housing 102 formed collectively by a main subhousing 112 (which forms a part of the main subassembly 110), a bus subhousing 132 and tap subhousings 142 (which form parts of the tap subsassemblies 140, 140'). The connector assembly 100 also includes an environmental seal system 160 formed collectively by main seal members 162 and tap seal members 164, which form parts of the main subassembly 110 and the tap subsassemblies 140, 140', respectively. The subassemblies 110, 130, 140, 140' can be used to cooperatively mechanically capture the cables 12, 14, 16 therebetween and electrically connect the conductors 12A, 14A, 16A to one another.

Figure 3:
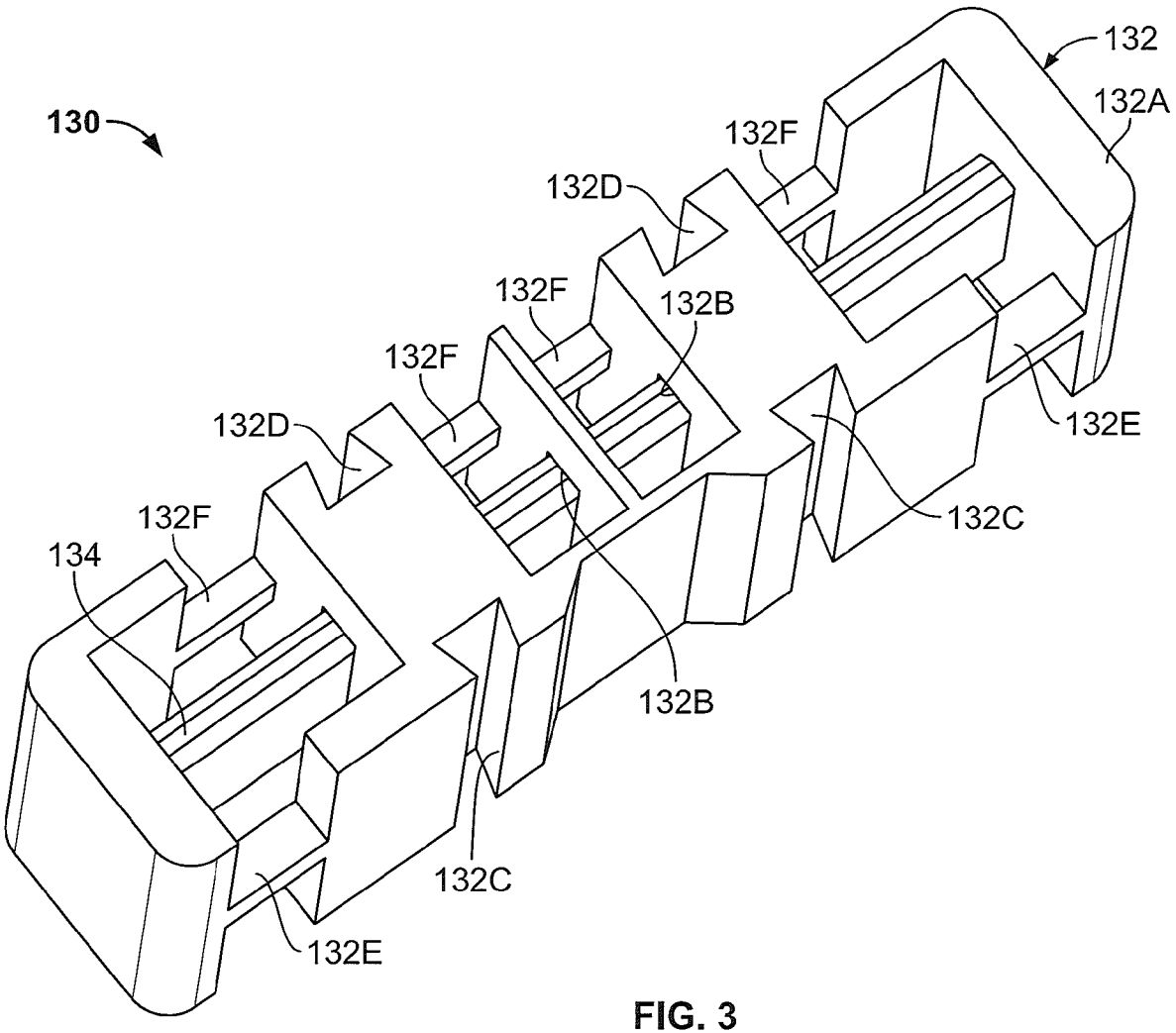
FIG. 3 is a perspective view of a bus member assembly forming a part of the connector assembly of FIG. 1.

With reference to FIGS. 2 and 3, the bus subassembly 130 includes the subhousing 132 and a busbar or bus member 134 mounted therein.

The subhousing 132 includes a body 132A having bus member slots 132B, main guide slots 132C, tap guide slots 132D, main blade slots 132E and tap blade slots 132F defined therein. The subhousing 132 may be formed of any suitable material. According to some embodiments, the subhousing 132 is formed of a polymeric material. In some embodiments, the polymeric material is selected from the group consisting of polyamide (PA) 6.6, PA 6.6 reinforced with glass fibers or talc, polycarbonate, or polycarbonate blend. The subhousing 132 may be formed using any suitable technique. According to some embodiments, the subhousing 132 is molded. According to some embodiments, the subhousing 132 is monolithic and unitarily formed.

Figure 7:
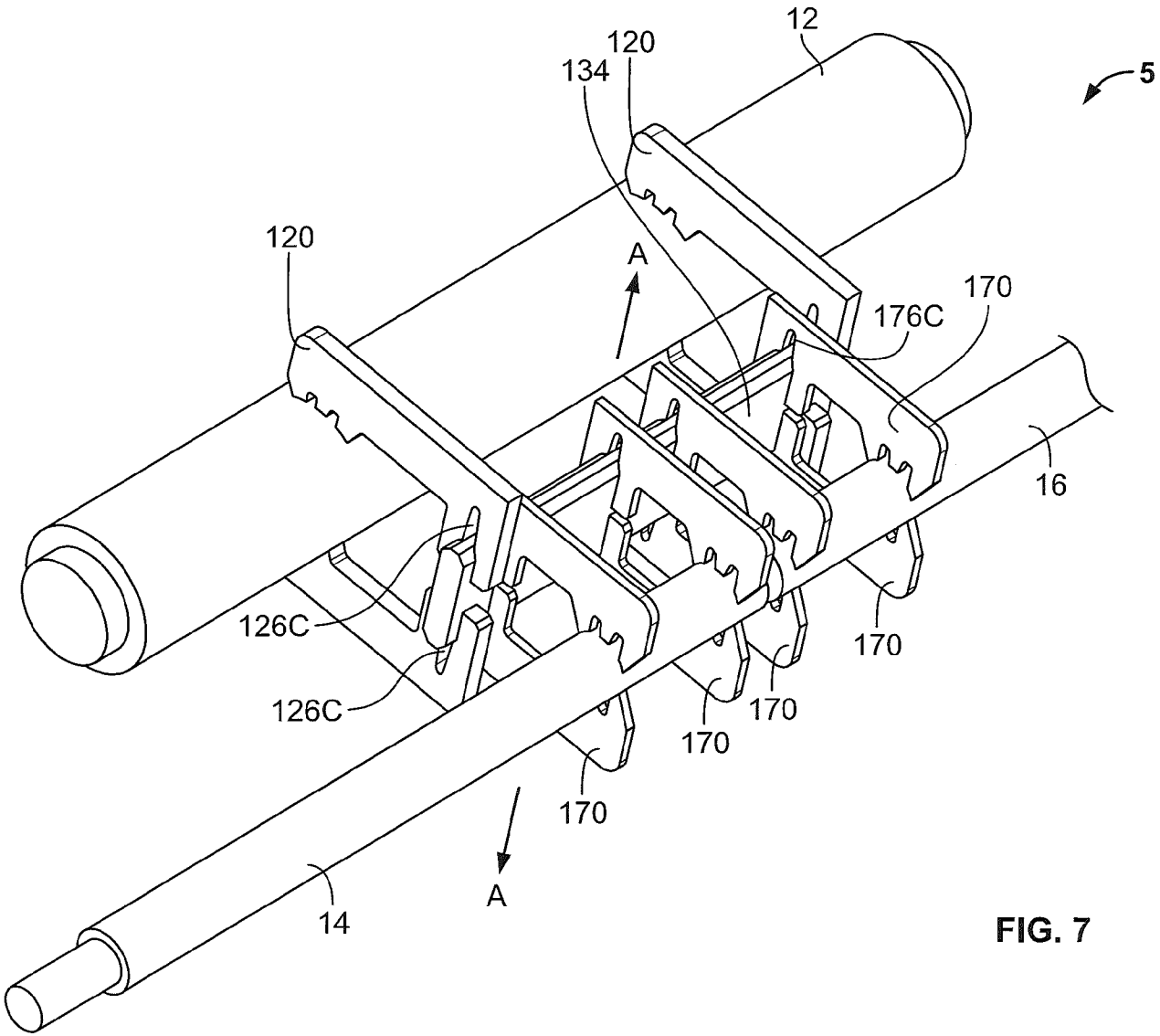
FIG. 7 is a fragmentary, perspective view of the connection of FIG. 1 with only cables, and a bus member, main blade members and tap blade members of the connector assembly being shown, for the purpose of explanation.
Figure 8:
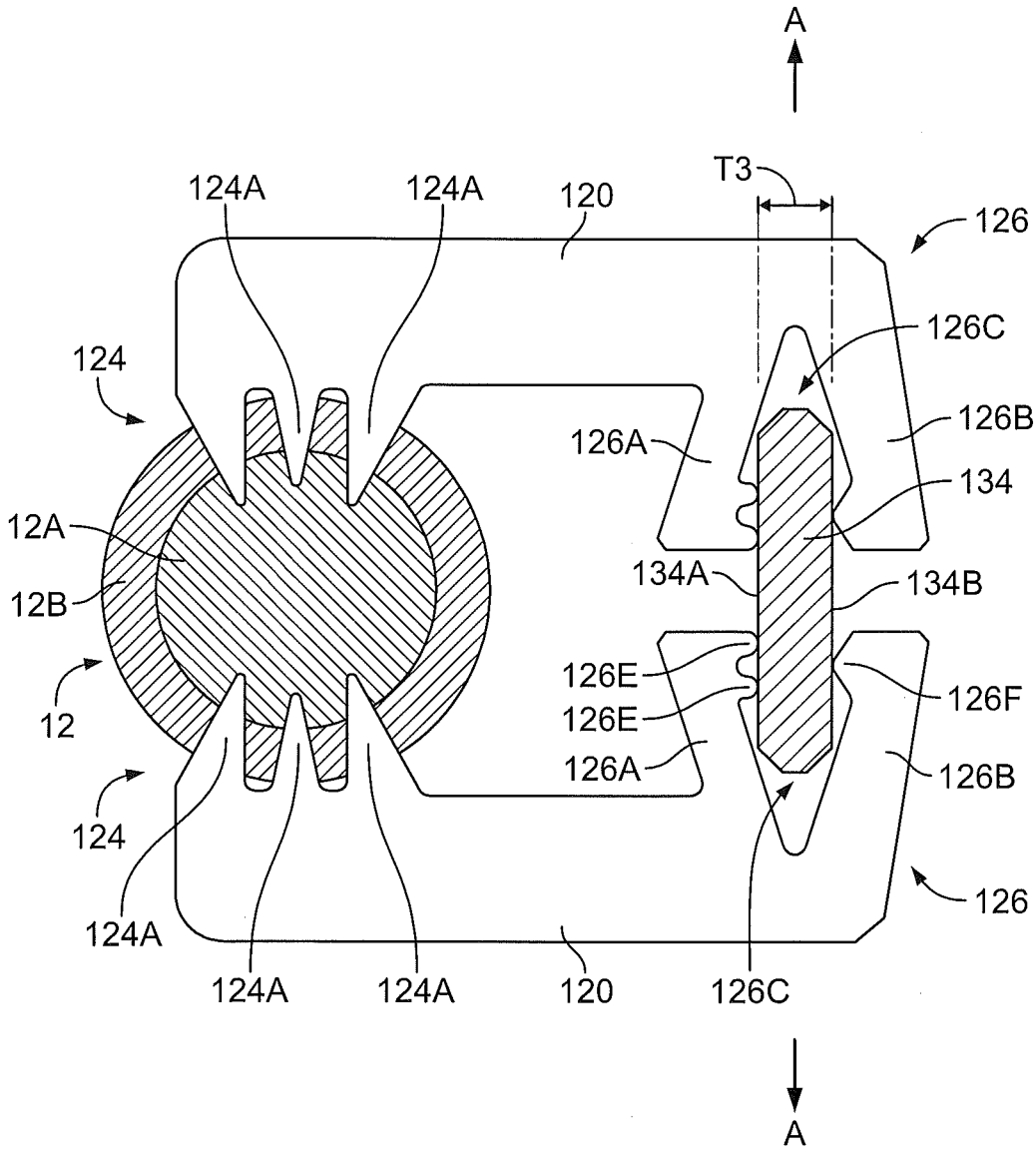
FIG. 8 is a fragmentary, cross-sectional, end view of the connection of FIG. 1 showing a main cable, the bus member, and a pair of the main blade members.

The bus member 134 is mounted in the bus member slots 132B. According to some embodiments and as illustrated, the bus member 134 may be shaped as an elongate flat rod or plate having opposed lateral sides 134A and 134B. The bus member 134 defines a slide axis A-A (FIGS. 7 and 8).

The bus member 134 may be formed of any suitable electrically conductive material. According to some embodiments, the bus member 134 is formed of metal. According to some embodiments, the bus member 134 is formed of aluminum, aluminum or copper and may be galvanized. The bus member 134 may be formed using any suitable technique. According to some embodiments, the bus member 134 is monolithic and unitarily formed. According to some embodiments, the bus member 134 is extruded and cut, stamped (e.g., die-cut), cast and/or machined. According to some embodiments, the subhousing 132 is molded (e.g., insert molded) about the bus member 134.

The main subassembly 110 (FIGS. 1 and 2) includes the subhousing 112, the two main seal members 162, a compression mechanism or fastener assembly 116, and upper and lower pairs of blade members 120 (four total).

The subhousing 112 (FIG. 2) includes upper and lower subhousing members 114. Each subhousing member 114 includes a body 114A and integral legs 114G. The body 114A and legs 114G have a cable groove 114B, a fastener bore 114C, guide features (rails) 114D, a pair of blade slots 114E, and a pair of bus member slots 114F defined therein. The cable groove 114B has a lengthwise groove axis B-B.

The subhousing members 114 may be formed of any suitable material. According to some embodiments, the subhousing members 114 are formed of a polymeric material. In some embodiments, the polymeric material is selected from the group consisting of polyamide (PA) 6.6, PA 6.6 reinforced with glass fibers or talc, polycarbonate, or polycarbonate blend. The subhousing members 114 may be formed using any suitable technique. According to some embodiments, the subhousing members 114 are molded. According to some embodiments, each of the subhousing members 114 is monolithic and unitarily formed.

Each main seal member 162 (FIG. 2) includes legs 162D and has a cable groove 162A, a fastener bore 162B, and a pair of blade slots 162C. The main seal members 162 may be formed of any suitable material. According to some embodiments, the main seal members 162 are formed of an elastomeric material. In some embodiments, the elastomeric material is selected from the group consisting of rubber, polypropylene, PVC, silicone, neoprene, santoprene, EPDM, or EPDM and polypropylene blend. The main seal members 162 may be formed using any suitable technique. According to some embodiments, the main seal members 162 are molded. According to some embodiments, each of the main seal members 162 is monolithic and unitarily formed.

Figure 4:
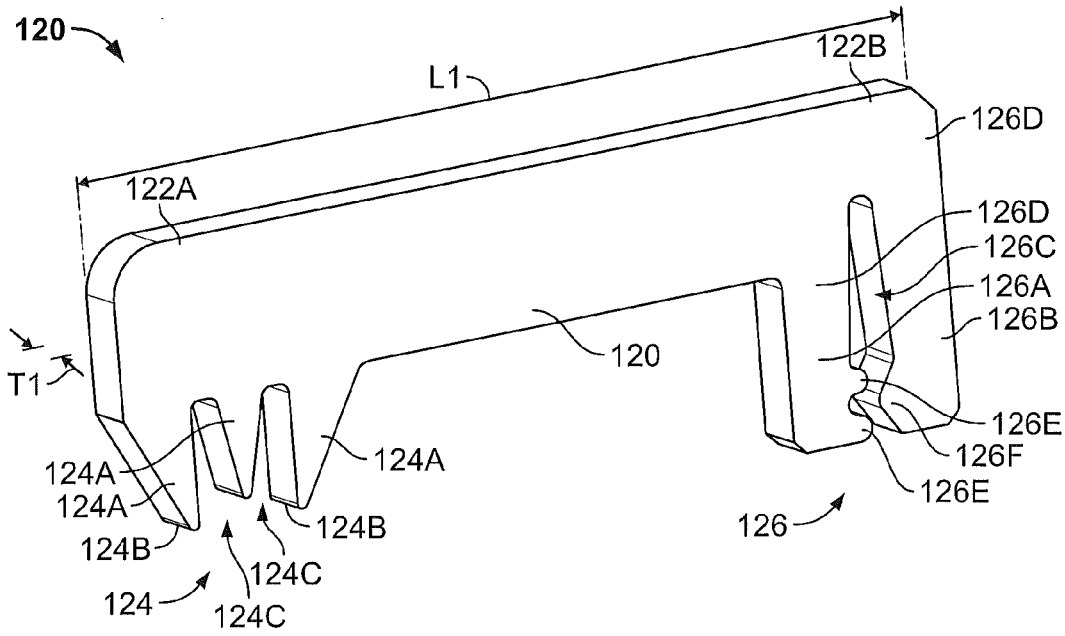
FIG. 4 is a perspective view of a main blade member forming a part of the connector assembly of FIG. 1.

According to some embodiments and as illustrated, the blade members 120 are identically formed. However, in some embodiments, the blade members 120 may be configured differently from one another. With reference to FIG. 4, a representative one of the blade members 120 includes a body 122 having an outer end 122A and an inner end 122B. An integral cable engagement or insulation piercing feature 124 is located on the outer end 122A and an integral bus member coupling feature 126 is located on the inner end 122B.

The insulation piercing feature 124 includes a plurality of teeth 124A (as shown, three) separated by slots 124C and having terminal points 124B. The points 124B collectively lie on an arc generally corresponding to the profile of the arcuate outer surface of the cable conductor 12A.

The coupling feature 126 includes opposed spring fingers 126A, 126B defining a receptacle or slot 126C therebetween and joined to the body 122 at pivot ends 126D. Teeth 126E extend into the slot 126C from the finger 126A and a tooth 126F extends into the slot 126C from the finger 126B.

According to some embodiments, the length L1 of the blade member 120 is at least ten times its thickness T1. According to some embodiments, the thickness T1 of the blade member is between about 0.20 mm and 5.0 mm.

The blade members 120 may be formed of any suitable electrically conductive material. According to some embodiments, the blade members 120 are formed of metal. According to some embodiments, the blade members 120 are formed of aluminum, aluminum alloy, or copper and may be galvanized. The blade members 120 may be formed using any suitable technique. According to some embodiments, each blade members 120 is monolithic and unitarily formed. According to some embodiments, each blade member 120 is extruded and cut, stamped (e.g., die-cut), cast and/or machined.

The compression mechanism 116 includes a bolt 116A and a shear nut 116D mounted on a threaded shank 116C of the bolt 116A. The shear nut 116D may include a shear head 116B and a base 116E. The head 116B may be configured to operably engage a driver to be forcibly driven by the driver. The nut 116D includes a breakaway section between the base 116E and the head 116B. The head 116B is configured to shear off of the base 116E at the breakaway section when subjected to a prescribed torque. According to some embodiments, the bolt 116A is formed of steel, galvanized steel or stainless steel, and the nut 116D is formed of aluminum alloy, plastic or zinc alloy.

Figure 6:
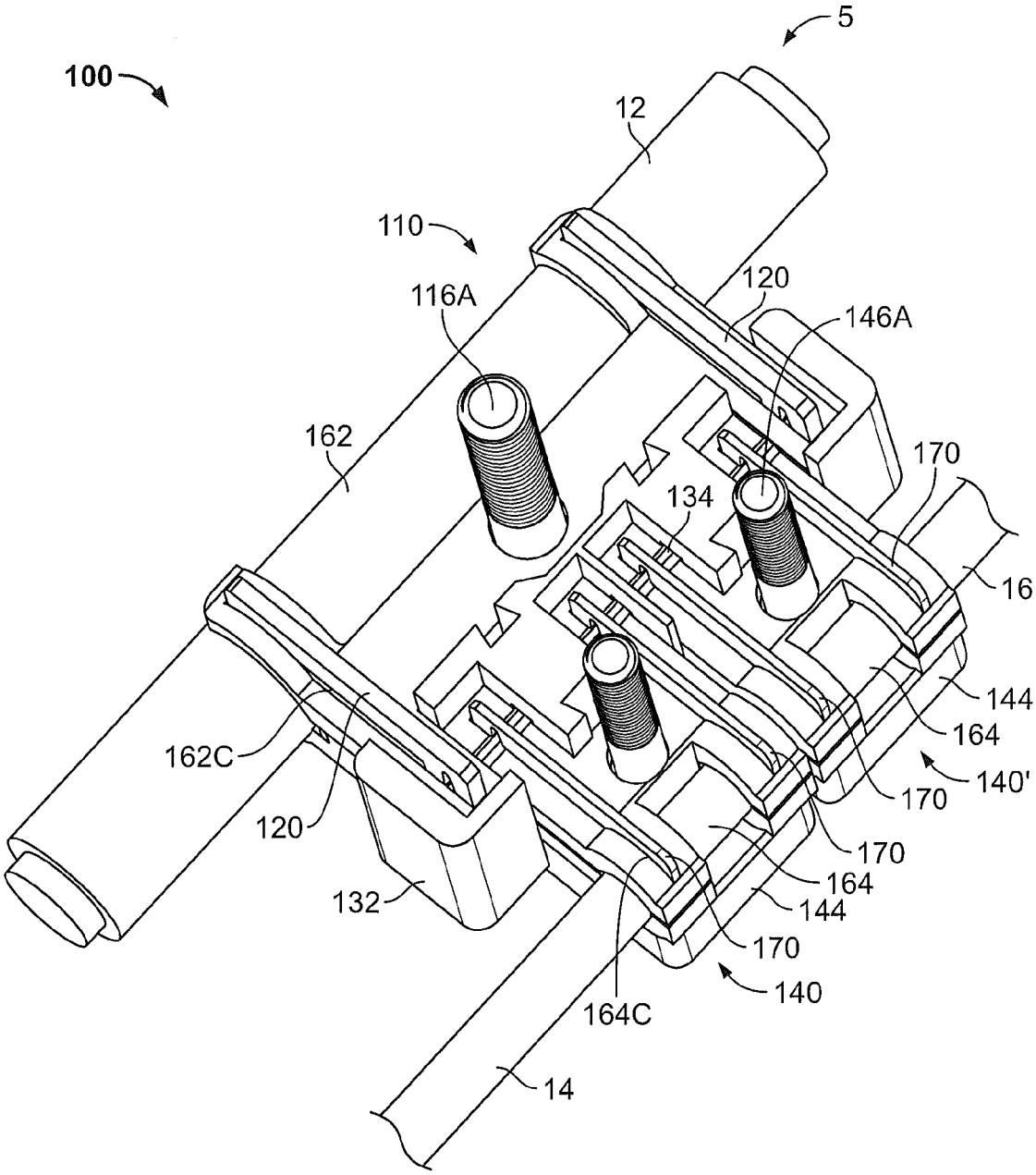
FIG. 6 is a fragmentary, perspective view of the connection of FIG. 1 with main and tap subhousings of the connector assembly removed for the purpose of explanation.

With reference to FIGS. 2-3 and 6, the seal members 162 are each seated in a respective one of the subhousing members 114. The blade members 120 are each seated in a respective blade member slot 162C (of the seal member 162) and the adjacent blade member slot 114E (of the subhousing member 114) such that the slot 126C aligns with the corresponding slot 114F. These subassemblies are each mounted on the bus member subassembly 130 such that the legs 114G, 162D extend into the slots 132E, the guide rails 114D are slidably seated in the guide slots 132B, and the bus member 134 is slidably received in the blade member slot 126C of each blade member 120 (see FIG. 6). More particularly, each finger 126A, 126B engages a respective side 134A, 134B of the bus member 134. According to some embodiments and with reference to FIG. 8, the thickness T3 of the bus member 134 is greater than the width W3 between the teeth 126E and the tooth 126F so that one or both of the fingers 126A, 126B of each blade member 120 is or are elastically deflected away from the another and, as a result, the fingers 126A, 126B exert a compressive force on the bus member 134 when installed on the bus member 134.

The tap subassemblies 140, 140' may be constructed in the same manner or identically, or may be differently constructed. The tap subassembly 140 will be described hereinbelow in more detail, it being appreciated that this description may likewise apply to the tap subassembly 140'.

With reference to FIG. 2, the tap subassembly 140 includes the subhousing 142, the two tap seal members 164, a compression mechanism or fastener assembly 146, and upper and lower pairs of blade members 170.

The subhousing 142 includes upper and lower subhousing members 144. Each subhousing member 144 includes a body 144A and legs 144G. The body 144A and legs 144G have a cable groove 144B, a fastener bore 144C, a guide feature (rail) 144D, a pair of blade slots 144E, and a pair of bus member slots 144F defined therein. The cable groove 144B has a lengthwise groove axis C-C.

The subhousing members 144 may be formed of a suitable material and in a manner as described above with respect to the subhousing members 114. According to some embodiments, each of the subhousing members 144 is monolithic and unitarily formed.

Each tap seal member 164 includes legs 164D and has a cable groove 164A, a fastener bore 164B, and a pair of blade slots 164C. The tap seal members 164 may be formed of a suitable material and in a manner as described above with regard to the main seal members 162. According to some embodiments, each of the tap seal members 164 is monolithic and unitarily formed.

Figure 5:
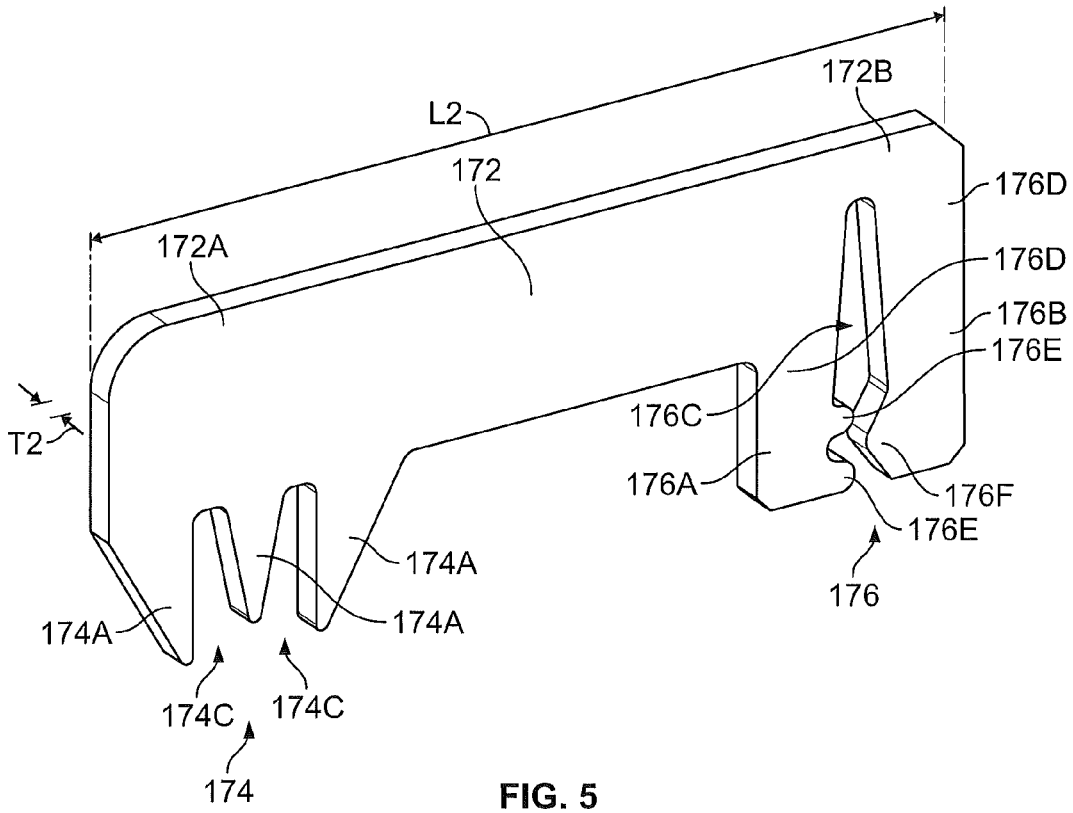
FIG. 5 is a perspective view of a tap blade member forming a part of the connector assembly of FIG. 1.

According to some embodiments and as illustrated, the blade members 170 are identically formed. However, in some embodiments, the blade members 170 may be configured differently from one another. With reference to FIG. 5, a representative one of the blade members 170 includes a body 172 having an outer end 172A and an inner end 172B. An integral cable engagement or insulation piercing feature 174 is located on the outer end 172A and an integral bus member coupling feature 176 is located on the inner end 172B. The insulation piercing feature 174 can be configured in the same manner as the insulation piercing feature 124 as described above. The coupling feature 176 can be configured in the same manner as the coupling feature 126 as described above.

The insulation piercing feature 174 includes a plurality of teeth 174A separated by slots 174C and having terminal points 174B. The points 174B collectively lie on an arc generally corresponding to the profile of the arcuate outer surface of the cable conductor 14A.

The coupling feature 176 includes opposed spring fingers 176A, 176B defining a receptacle or slot 176C therebetween and joined to the body 172 at pivot ends 176D. Teeth 176E extend into the slot 176C from the finger 176A and a tooth 176F extends into the slot 176C from the finger 176B.

The blade members 170 may be formed of any suitable electrically conductive material. According to some embodiments, the blade members 170 are formed of metal. According to some embodiments, the blade members 170 are formed of aluminum, aluminum alloy, or copper and may be galvanized. The blade members 170 may be formed using any suitable technique. According to some embodiments, each blade members 170 is monolithic and unitarily formed. According to some embodiments, each blade member 170 is extruded and cut, stamped (e.g., die-cut), cast and/or machined.

According to some embodiments, the blade members 170 have the same relative dimensions as the blade members 120 described above. According to some embodiments, the blade members 170 are smaller than the blade members 120.

According to some embodiments, the length L1 of the blade member 170 is at least ten times its thickness T1. According to some embodiments, the thickness T1 of the blade member is between about 0.20 mm and 5.0 mm.

The compression fastener 146 includes a bolt 146A and a shear nut 146D corresponding to and operable in the same manner as the bolt 116A and the shear nut 116D.

With reference to FIGS. 2 and 6, the seal members 164 are each seated in a respective one of the subhousing members 144. The blade members 170 are each seated in a respective blade member slot 164C (of the seal member 164) and the adjacent blade member slot 144E (of the subhousing member 144) such that the slot 176C aligns with the corresponding slot 144F. These subassemblies are each mounted on the bus member subassembly 130 such that the legs 144G, 164D extend into the slots 132F, the guide rails 144D are slidably seated in the guide slots 132D, and the bus member 134 is slidably received in the blade member slot 176C of each blade member 170. More particularly, each finger 176A, 176B engages a respective side 134A, 134B of the bus member 134. According to some embodiments, the thickness T3 of the bus member 134 is greater than the width between the teeth 176E and the tooth 176F (FIG. 7) so that one or both of the fingers 176A, 176B of each blade member 170 are elastically deflected away from the other and, as a result, the fingers 176A, 176B exert a compressive force on the bus member 134 when installed on the bus member 134.

With reference to FIGS. 1, 2 and 6-8, exemplary methods for assembling and using the connector assembly 100 in accordance with embodiments of the present invention will now be described.

If necessary, the compression mechanism 116 is loosened or opened to permit the subhousing members 114 (and thereby the blade members 120) to be separated. The main cable 12 (with the insulation layer 12B covering the conductor 12A) is inserted in or between the cable grooves 114B. The shear nut 116D is then driven to compress the compression mechanism 116 and thereby drive the subhousing members 114 together. As a result, the insulation piercing features 124 of the opposed pairs of the blade members 120 are driven to converge on and capture the cable 12 therebetween. More particularly, the teeth 124A of each blade member 120 are forced through the insulation layer 12B and into mechanical and electrical contact with the conductor 12A. The teeth 124A embed in the insulation layer 12B. According to some embodiments, the teeth 124A embed in the conductor 12A as shown in FIG. 8. According to some embodiments, the teeth 124A embed into the conductor 12A a distance of at least about 0.5 mm. The seal members 162 engage and form an environmental seal about the section of the cable 12 in the subhousing 112.

According to some embodiments, as the blade members 120 are displaced or repositioned relative to one another during the steps of opening and closing the subassembly 110, the blade members 120 slide up and down along the bus member 134 while the spring legs 126A, 126B maintain constant contact with the opposed sides 134A, 134B of the bus member 134. This contact may be ensured by the spring action or loading of the fingers 126A, 126B. The guide features 114D, 132C cooperate to ensure that the blade members 120 slide in parallel to one another and the slide axis A-A (FIGS. 7 and 8).

The shear nut 116D is driven until a prescribed torque is applied, whereupon the shear head 116B will break off, thereby helping to ensure that the proper load is applied to the blade members 120. In the foregoing manner, the connector assembly 100 is operatively connected to the main cable 12 without stripping the insulation layer 12B.

Because the main subassembly 110 employs blade members 120 that move and engage the main cable 12 independently of the tap subassemblies 140, 140' and the blade members 170 thereof, the main subassembly 110 can be configured to properly engage a range of main cable sizes independent of the ranges of cable sizes for which the tap subassemblies 140, 140' are adapted. The tap subassemblies 140, 140' can likewise be adapted to engage different tap cable size ranges from one another.

Independently of connecting the connector assembly 100 to the main cable 12, the connector assembly 100 can be connected to the tap cable 14 as follows using the first tap subassembly 140. If necessary, the compression mechanism 146 is loosened or opened to permit the subhousing members 144 (and thereby the blade members 170) to be separated. The tap cable 14 (with the insulation layer 14B covering the conductor 14A) is inserted in or between the cable grooves 144B. The shear nut 146D is then driven to compress the compression mechanism 146 and thereby drive the subhousing members 144 together. As a result, the insulation piercing features of the opposed pairs of the blade members 170 are driven to converge on and capture the cable 14 therebetween. More particularly, the teeth 174A of each blade member 170 are forced through the insulation layer 14B and into mechanical and electrical contact with the conductor 14A. The teeth 174A embed in the insulation layer 14B. According to some embodiments, the teeth 174A embed in the conductor 14A. According to some embodiments, the teeth 174A embed into the conductor 14A a distance of at least about 0.5 mm. The seal members 164 engage and form an environmental seal about the section of the cable 14 in the subhousing 142.

According to some embodiments, as the blade members 170 are displaced or repositioned relative to one another during the steps of opening and closing the subassembly 140, the blade members 170 slide up and down along the bus member 134 while the spring legs 176A, 176B maintain constant contact with the opposed sides 134A, 134B of the bus member 134. The spring loading of the fingers 176A, 176B may ensure contact between the fingers 176A, 176B and the bus member 134. The guide features 144D, 132D cooperate to ensure that the blade members 170 slide in parallel to one another and the slide axis A-A. The shear nut 146D may be driven until a prescribed torque is applied and the head thereof breaks off. In the foregoing manner, the connector assembly 100 is operatively connected to the tap cable 14 without stripping the insulation layer 14B from the section of the cable 14 engaged by the connector assembly 100.

Independently of connecting the connector assembly 100 to the main cable 12 using the subassembly 110 and connecting the connector assembly 100 to the tap cable 14 using the first tap subassembly 140, the connector assembly 100 can be connected to the tap cable 16 using the subassembly 140' in the same manner as described for connecting the subassembly 140 to the tap cable 14.

In the foregoing manner, the connection 5 (FIGS. 1, 6 and 7) can be formed. The blade members 120, 170 and the bus member 134 provide electrical continuity (i.e., a path for electrical current flow) between the conductors 12A, 14A, 16A of the cables 12, 14, 16. The connection assembly 100 mechanically secures the cables 12, 14, 16 relative to one another. Moreover, the connection assembly 100 provides environmental protection for the locations in the insulation layers 12B, 14B, 16B pierced by the blade members 120, 170.

Figure 9:
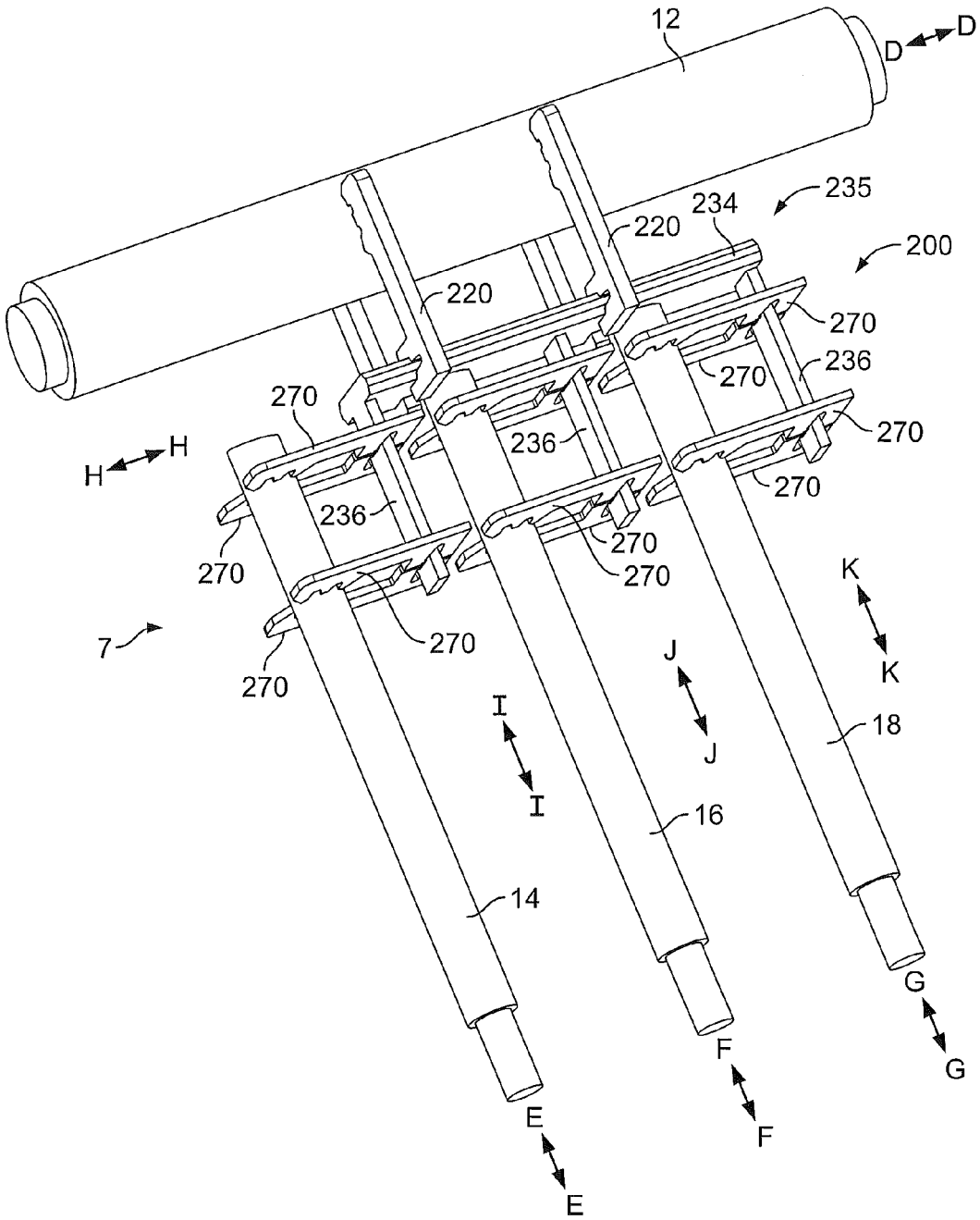
FIG. 9 is a fragmentary, perspective view of a connection including a connector assembly according to further embodiments of the present invention.

With reference to FIG. 9, a multi-tap or multi-cable insulation piercing electrical connector assembly 200 according to further embodiments of the present invention is shown therein connecting cables 12, 14, 16, and 18 to form a connection 7. The connector assembly 200 includes a bus member 235, main blade members 220 and tap blade members 270. The connector assembly 200 may be constructed and operable in the same manner as the connector assembly 100, except as follows. For the purpose of explanation, only the cables 12, 14, 16, 18, the bus member 234, and the blade members 220, 270 are shown in FIG. 9. Although not shown, the connector assembly 200 may further include a main subhousing corresponding to the main subhousing 112, main seal members corresponding to the seal members 162, and a compression mechanism corresponding to the compression mechanism 116, a bus member subhousing corresponding to the subhousing 132, and, for each of the pairs of blades 270 associated with a respective tap cable 14, 16, 18, a subhousing corresponding to the subhousing 144, tap seal members corresponding to the seal members 164, and a compression mechanism corresponding to the compression mechanism 146.

The bus member 235 includes a main section 234 corresponding to the bus member 134 having a lengthwise axis H-H. The bus member 235 further includes three tap sections or legs 236 integral with the main section 234. Each leg 236 has a lengthwise axis I-I, J-J, K-K transverse to the axis H-H. According to some embodiments, the axes I-I, J-J, K-K are substantially perpendicular to the axis H-H. When the cables 12, 14, 16, 18 are installed in the connector assembly 200, the cable lengthwise axes D-D, E-E, F-F and G-G, will extend substantially parallel to the axes H-H, I-I, J-J and K-K, respectively.

The blade members 220 correspond to the blade members 120 and are slidably mounted on the section 234 in the same manner and to the same effect as described above with regard to the blade members 120. Each set of two opposed pairs of blade members 270 corresponds to a set of the tap blade members 170, and is slidably mounted on a respective leg 236 in the same manner and to the same effect as described above with regard to the blade members 170.

It will be appreciated that the connector assembly 200 can be used in similar manner as the connector assembly 100 except that the tap cables 14, 16, 18 are oriented at a transverse or perpendicular angle relative to the main cable 12 in the completed connection 7. While three legs 236 and tap cables are shown, according to further embodiments, more or fewer legs 236 and tap subassemblies can be provided in a given connector assembly (e.g., by extending the main section 234 and adding legs 236).

The bus member 235 can be formed in any suitable manner, such as by bending and/or welding a bar or bars of metal.

Figure 10:
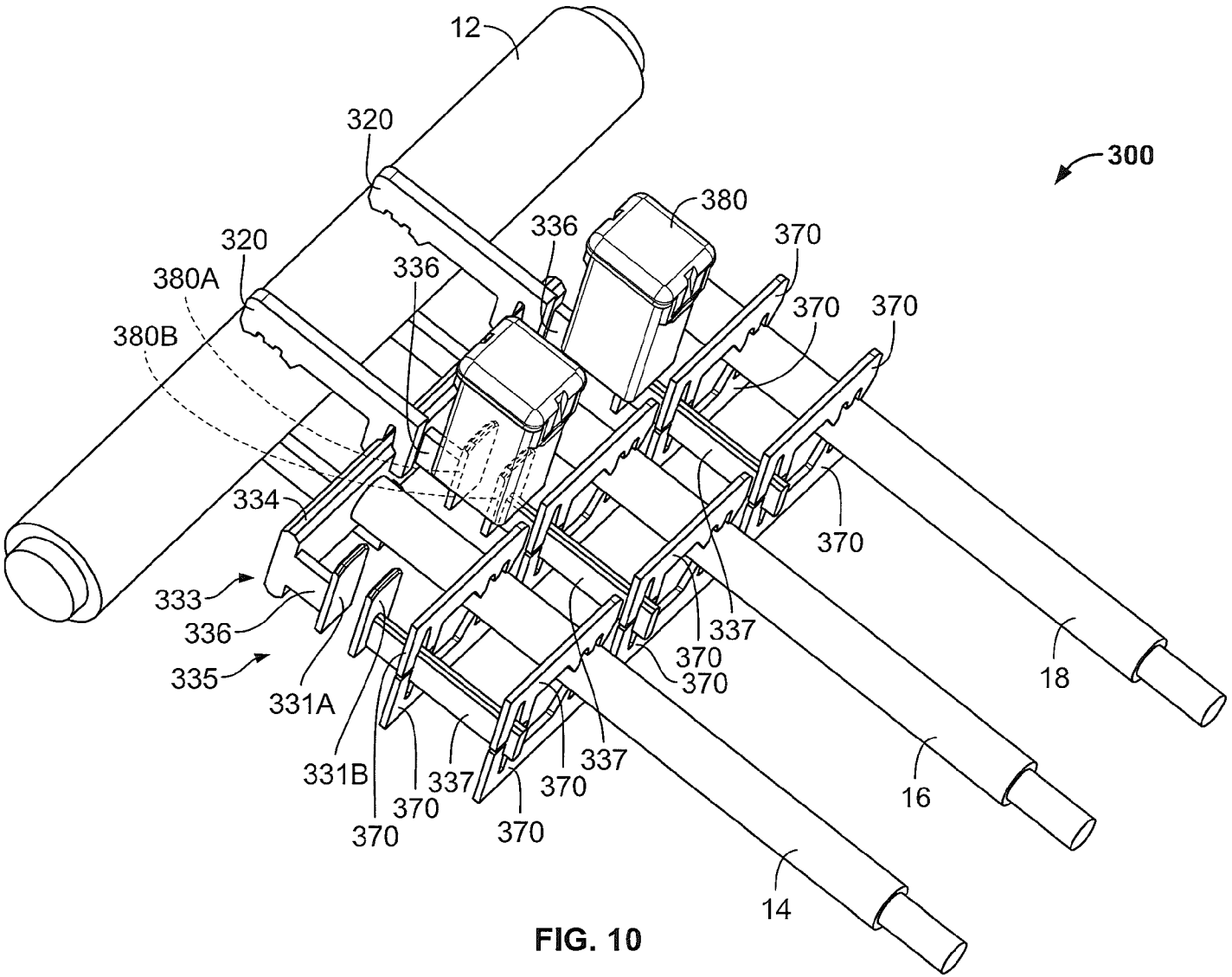
FIG. 10 is a fragmentary, perspective view of a connection including a connector assembly according to further embodiments of the present invention.

With reference to FIG. 10, a multi-tap or multi-cable insulation piercing electrical connector assembly 300 according to further embodiments of the present invention is shown therein connecting cables 12, 14, 16, and 18 to form a connection 9. The connector assembly 300 includes a multi-piece bus assembly 335, main blade members 320, tap blade members 370, and three modular electrical protection functional components 380 (one of which is removed for the purpose of explanation). The connector assembly 300 may be constructed and operable in the same manner as the connector assembly 100, except as follows. For the purpose of explanation, only the cables 12, 14, 16, 18, the bus assembly 335, the blade members 320, 370, and the electrical protection functional components 380 are shown in FIG. 10. Though not shown, the connector assembly 300 may further include a main subhousing corresponding to the main subhousing 112, main seal members corresponding to the seal members 162, and a compression mechanism corresponding to the compression mechanism 116, a bus member subhousing corresponding to the subhousing 132, and, for each of the pairs of blades 370 associated with a respective tap cable 14, 16, 18, a subhousing corresponding to the subhousing 144, tap seal members corresponding to the seal members 164, and a compression mechanism corresponding to the compression mechanism 146.

The bus assembly 335 includes a primary bus member 333 and three tap bus members 337. The primary bus member 333 includes a main section 334 corresponding to the bus member 134 having a lengthwise axis. The bus member 333 further includes three tap sections or legs 336 integral with the main section 234. Each leg 336 has a lengthwise axis transverse to the lengthwise axis of the section 334. According to some embodiments, the leg axes are substantially perpendicular to the lengthwise axis of the section 334. Each leg 336 also has a male connection feature or tab 331A on its terminal end. Each tap bus member 337 similarly has a male connection feature or tab 331B on a terminal end thereof.

The blade members 320 correspond to the blade members 120 and are slidably mounted on the section 334 in the same manner and to the same effect as described above with regard to the blade members 120. Each set of two opposed pairs of blade members 370 corresponds to a set of the tap blade members 170, and is slidably mounted on a respective leg 336 in the same manner and to the same effect as described above with regard to the blade members 170.

Each electrical protection functional component 380 is mounted on and bridges a respective leg 336 and a respective bus member 337. The components 380 each have a pair of female connection sockets 380A, 380B that receive respective ones of the connection tabs 331A, 331B. In this manner, electrical continuity is provided between the main blade members 320 and the tap blade members 370 (and thereby between the main cable 12 and the tap cables 14, 16, 18) through the respective electrical protection functional components 380.

The electrical protection functional components 380 may be any suitable electrical protection functional components. According to some embodiments, the electrical protection functional components 380 are fuses such as slow blow fuses. If desired, the components 380 can be used as current interrupt switches between the cable 12 and selected cables 14, 16, 18 by removing and replacing the components 380 on the connection features 331A, 331B.

Figure 11:
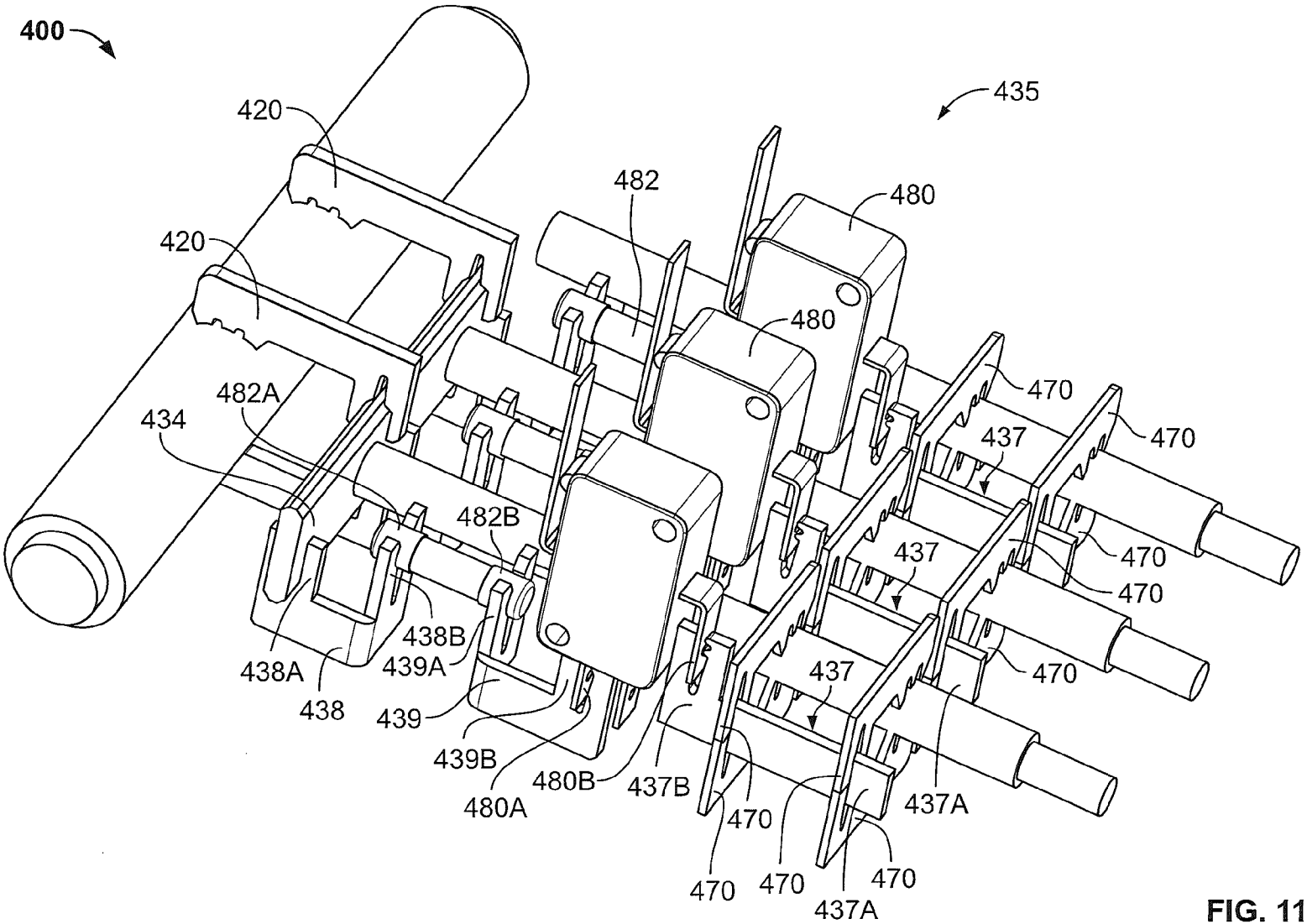
FIG. 11 is a fragmentary, perspective view of a connection including a connector assembly according to further embodiments of the present invention.

With reference to FIG. 11, a multi-tap or multi-cable insulation piercing electrical connector assembly 400 according to further embodiments of the present invention is shown therein connecting cables 12, 14, 16, and 18 to form a connection 11. The connector assembly 400 includes a multi-piece bus assembly 435, main blade members 420, tap blade members 470, three electrical protection functional components 480 (as shown, electrical switches, such as microswitches), and three electrical protection functional components 482 (as shown, tube fuses). The connector assembly 400 may be constructed and operable in the same manner as the connector assembly 100, except as follows. For the purpose of explanation, only the cables 12, 14, 16, 18, the bus assembly 435, the blade members 420, 470, and the electrical protection functional components 480, 482 are shown in FIG. 11. Though not shown, the connector assembly 400 may further include a main subhousing corresponding to the main subhousing 112, main seal members corresponding to the seal members 162, and a compression mechanism corresponding to the compression mechanism 116, a bus member subhousing corresponding to the subhousing 132, and, for each of the pairs of blades 470 associated with a respective tap cable 14, 16, 18, a subhousing corresponding to the subhousing 144, tap seal members corresponding to the seal members 164, and a compression mechanism corresponding to the compression mechanism 146.

The bus assembly 435 includes a primary bus member 434, three tap bridge bus members 438, three intermediate bus members 439, and three tap bus members 437. Each of the bus members 434, 437, 438, 439 may be formed of any suitable electrically conductive material, as described above with regard to the bus member 134.

The primary bus member 434 corresponds to the bus member 134 and has a lengthwise axis. The blade members 420 correspond to the blade members 120 and are slidably mounted on the bus member 434 in the same manner and to the same effect as described above with regard to the blade members 120.

Each tap bridge bus member 438 has an integral coupling feature 438A on one end and an integral component mounting feature 438B on its opposite end. The coupling feature 438A may be constructed and operate in the manner described for the bus member coupling features 126 above. The component mounting feature 438B may be of any suitable configuration to operatively engage a component 482. As shown, the component mounting feature 438B is a female connection feature defining a slot sized and shaped to form a spring biased and/or interference fit with an electrical end contact 482A of the component 482. Each tap bridge member 438 is slidably mechanically and electrically coupled to the primary bus member 434 by its coupling feature 438A. The tap bridge bus members 438 extend transversely and, according to some embodiments, perpendicularly, to the primary bus member 434.

Each intermediate bus member 439 has an integral component mounting feature 439A of a first type on one end and an integral component mounting feature 439B of a second type on its opposite end. The component mounting feature 439A may be of any suitable configuration to operatively engage a component 482. As shown, the component mounting feature 439A defines a slot sized and shaped to form a spring biased and/or interference fit with an electrical end contact 482B of the component 482. Similarly, the component mounting feature 439B may be of any suitable configuration to operatively engage a component 480. As shown, the component mounting feature 439B defines a slot sized and shaped to form a spring biased and/or interference fit with an electrical male contact tab 480A of the component 480. Each intermediate bus member 439 is directly electrically connected to a respective tap bridge bus member 438 by a respective electrical protection functional component 482 (tube fuse).

Each tap bus member 437 includes a body 437A having an integral component mounting feature 437B on one end. The component mounting feature 437B may be configured as described for the integral component mounting feature 439B. Each tap bus member 437 is directly electrically connected to a respective intermediate bus member 439 by a respective electrical protection functional component 480 (switch). More particularly, the component mounting feature 437B receives and holds an electrical male contact tab 480B of the component 480.

Each set of two opposed pairs of blade members 470 corresponds to a set of the tap blade members 170, and is slidably mounted on a respective tap bus member 437 in the same manner and to the same effect as described above with regard to the blade members 170.

Electrical continuity is provided between the main blade members 420 and the tap blade members 470 (and thereby between the main cable 12 and the tap cables 14, 16, 18) through the primary bus member 434 and the respective tap bridge bus members 438, electrical protection functional components 482, the intermediate bus members 439, the electrical protection functional components 480, and the tap bus members 437.

While the electrical protection functional components 380, 480 and 482 as disclosed above are fuses or switches and packaged as modules with male contacts, modules with female contacts, and tubular modules, any suitable electrical protection functional components and/or combination of electrical protection functional components may be integrated into electrical connector assemblies as described herein in accordance with embodiments of the invention.

Connector assemblies as disclosed herein can be designed and assembled using a modular system according to embodiments of the present invention. Various components as disclosed herein can be assembled together in various combinations and numbers depending on the requirements for the connector assembly. Such assembly may be executed at the factory.

While shear nuts 116D, 146D have been shown and described herein, alternatively shear bolts may be used.

While various housing configurations have been shown and described herein for the connector assemblies 100, 200, 300, 400, housings having other shapes, sizes and components may be employed instead.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention. Therefore, it is to be understood that the foregoing is illustrative of the present invention and is not to be construed as limited to the specific embodiments disclosed, and that modifications to the disclosed embodiments, as well as other embodiments, are intended to be included within the scope of the invention.

That which is claimed is:

1. An electrical connector assembly for mechanically and electrically connecting first and second cables each including an elongate electrical conductor covered by an insulation layer, the electrical connector assembly comprising:

a housing configured to receive each of the first and second cables;

an electrically conductive bus member disposed in the housing;

an electrically conductive first blade member disposed in the housing and having an inner end, an outer end and an insulation piercing feature on the outer end, wherein the inner end is coupled to the bus member and the insulation piercing feature includes at least one tooth configured to pierce through the insulation cover of the first cable and electrically engage the conductor of the first cable; and an electrically conductive second blade member disposed in the housing and having an inner end, an outer end and an insulation piercing feature on the outer end, wherein the inner end is coupled to the bus member and the insulation piercing feature includes at least one tooth configured to pierce through the insulation cover of the second cable and electrically engage the conductor of the second cable;

wherein the bus member provides electrical continuity between the first and second blade members and thereby the conductors of the first and second cables when the conductors are engaged by the insulation piercing feature of the first and second blade members.

2. The electrical connector assembly of claim 1 wherein the first blade member has a coupling feature on its inner end coupling the first blade member to the bus member, and the coupling feature is configured differently than the insulation piercing feature of the first blade member.

3. The electrical connector assembly of claim 2 wherein the coupling feature includes a receiver slot defined by at least one integral, deflectable finger, wherein the coupling feature is configured to receive the bus member such that the finger is deflected and exerts a persistent compressive load on the bus member to maintain electrical engagement between the first blade member and the bus member.

4. The electrical connector assembly of claim 3 wherein the coupling feature includes teeth on opposed sides of the receiver slot to engage opposed sides of the bus member.

5. The electrical connector assembly of claim 3 wherein:

the second blade member has a second coupling feature on its inner end coupling the second blade member to the bus member;

the second coupling feature is configured differently than the insulation piercing feature of the second blade member; and the second coupling feature includes a receiver slot defined by at least one integral, deflectable finger, wherein the second coupling feature is configured to receive the bus member such that the finger is deflected and exerts a persistent compressive load on the bus member to maintain electrical engagement between the second blade member and the bus member.

6. The electrical connector assembly of claim 1 further including:

an electrically conductive third blade member disposed in the housing opposite the first blade member and having an inner end, an outer end and an insulation piercing feature on the outer end, wherein the inner end is coupled to the bus member and the insulation piercing feature includes at least one tooth configured to pierce through the insulation cover of the first cable and electrically engage the conductor of the first cable; and an electrically conductive fourth blade member disposed in the housing opposite the second blade member and having an inner end, an outer end and an insulation piercing feature on the outer end, wherein the inner end is coupled to the bus member and the insulation piercing feature includes at least one tooth configured to pierce through the insulation cover of the second cable and electrically engage the conductor of the second cable.

7. The electrical connector assembly of claim 1 including:

a first compression mechanism operable to force the insulation piercing feature of the first blade member into engagement with the conductor of the first cable; and a second compression mechanism operable to force the insulation piercing feature of the second blade member into engagement with the conductor of the second cable independently of the first compression mechanism.

8. The electrical connector assembly of claim 7 wherein each of the first and second compression mechanisms includes a shear bolt or shear nut.

9. The electrical connector assembly of claim 7 wherein the first blade member has a coupling feature on its inner end coupling the first blade member to the bus member, and the coupling feature slides along and in contact with the bus member when the insulation piercing feature of the first blade member is forced into engagement with the first cable.

10. The electrical connector assembly of claim 1 wherein the housing includes:

a first subhousing containing the first blade member and configured to receive a portion of the first cable, the first subhousing including a seal member to provide an environmental seal between the first cable and the first subhousing; and a second subhousing containing the second blade member and configured to receive a portion of the second cable, the second subhousing including a seal member to provide an environmental seal between the second cable and the second subhousing.

11. The electrical connector assembly of claim 10 including a third subhousing containing the bus member, wherein the first subhousing is movable relative to the third subhousing.

12. The electrical connector assembly of claim 1 including an electrically conductive third blade member disposed in the housing and having an inner end, an outer end and an insulation piercing feature on the outer end, wherein the inner end is coupled to the bus member and the insulation piercing feature includes at least one tooth configured to pierce through an insulation cover of a third cable and electrically engage a conductor of the third cable.

13. The electrical connector assembly of claim 1 wherein:

the bus member includes a first leg and a second leg adjoining and disposed at an angle with respect to the first leg;

the inner end of the first blade member engages the first leg; and the inner end of the second blade member engages the second leg.

14. The electrical connector assembly of claim 1 including an integral electrical protection functional component disposed in the housing and electrically connecting the first and second blade members.

15. The electrical connector assembly of claim 14 wherein the electrical protection functional component includes a fuse.

16. The electrical connector assembly of claim 15 wherein the electrical protection functional component includes a tubular fuse.

17. The electrical connector assembly of claim 14 wherein the electrical protection functional component includes a switch.

18. A method for mechanically and electrically connecting first and second cables each including an elongate electrical conductor covered by an insulation layer, the method comprising:

providing an electrical connector assembly comprising:

a housing configured to receive each of the first and second cables;

an electrically conductive bus member disposed in the housing;

an electrically conductive first blade member disposed in the housing and having an inner end, an outer end and an insulation piercing feature on the outer end, wherein the inner end is coupled to the bus member and the insulation piercing feature includes at least one tooth configured to pierce through the insulation cover of the first cable and electrically engage the conductor of the first cable; and an electrically conductive second blade member disposed in the housing and having an inner end, an outer end and an insulation piercing feature on the outer end, wherein the inner end is coupled to the bus member and the insulation piercing feature includes at least one tooth configured to pierce through the insulation cover of the second cable and electrically engage the conductor of the second cable;

placing the first cable in the housing and forcing the first blade member into engagement with the first cable such that the at least one tooth of the first blade member pierces through the insulation cover of the first cable and electrically engages the conductor of the first cable; and placing the second cable in the housing and forcing the second blade member into engagement with the second cable such that the at least one tooth of the second blade member pierces through the insulation cover of the second cable and electrically engages the conductor of the second cable, wherein the bus member provides electrical continuity between the first and second blade members and thereby the conductors of the first and second cables.

19. The method of claim 18 wherein the first blade member has a coupling feature on its inner end coupling the first blade member to the bus member, and the coupling feature is configured differently than the insulation piercing feature of the first blade member.

20. The method of claim 19 wherein the coupling feature includes a receiver slot defined by at least one integral, deflectable finger, wherein the coupling feature is configured to receive the bus member such that the finger is deflected and exerts a persistent compressive load on the bus member to maintain electrical engagement between the first blade member and the bus member.

* * * * *

UNITED STATES PATENT AND TRADEMARK OFFICE

CERTIFICATE OF CORRECTION

PATENT NO. : 8,444,431 B1
APPLICATION NO. : 13/299972
DATED : May 21, 2013
INVENTOR(S) : José Alexandre La Salvia It is certified that error appears in the above-identified patent and that said Letters Patent is hereby corrected as shown below:

On Title Page:
Item [73]:
Please correct "Tyco Electronics Corporation, Berwyn, PA (US)"
to read -- Tyco Electronics Brasil LTDA, Sao Paolo (BR) --

Signed and Sealed this
Sixth Day of August, 2013

Teresa Stanek Rea
*Acting Director of the United States Patent and Trademark Office*